US005457615A

United States Patent [19]

Nezer

[11] Patent Number: 5,457,615

[45] Date of Patent: Oct. 10, 1995

[54] LIGHTING SYSTEMS

[76] Inventor: Daniel Nezer, 46A Hanassi Boulevard, Haifa 34643, Israel

[21] Appl. No.: 111,148

[22] Filed: Aug. 17, 1993

[30] Foreign Application Priority Data

Aug. 21, 1992 [IL] Israel ..... 102898

[51] Int. Cl.[6] ..... G09F 13/04

[52] U.S. Cl. ..... 362/223; 362/260; 40/564

[58] Field of Search ..... 362/223, 311, 362/355, 133, 222, 330, 332, 217, 260, 127, 225; 40/361, 564, 541

[56] References Cited

U.S. PATENT DOCUMENTS 2,355,731 8/1944 James ..... 362/125
4,298,916 11/1981 Shemitz ..... 362/127
5,101,331 3/1992 Katoh et al. ..... 362/223
5,282,117 1/1994 Fritts ..... 362/223
5,285,361 2/1994 McKillip ..... 362/125

*Primary Examiner*—Ira S. Lazarus
*Assistant Examiner*—Sara Sachie Raab
*Attorney, Agent, or Firm*—Abelman, Frayne & Schwab

[57] ABSTRACT

A lighting system of the kind having walls defining an enclosure, one or more display faces and electrical light sources located within the enclosure. Adjacent to individual light sources there are affixed light diffusers, interposed between the light sources and the display faces so as to prevent light rays emanating from the sources from directly reaching the display faces, but allowing light rays reflected from internal surfaces of the walls of the enclosure and from the diffusers, to reach the display faces.

16 Claims, 5 Drawing Sheets

LIGHTING SYSTEMS

The present invention relates to lighting systems and in particular, to internal electrical illumination structures having one or more display faces.

The structures, lighting systems or (illumination) structures referred to hereinafter, are known and used as store, street or institution (e.g., banks, schools, etc.) signs which, during the dark hours of the day, are illuminated.

Illuminated signs and other like lighting systems usually consist of an opal acrylic sheet or drawn "tub" covering a metal box which harbours fluorescent lights—most commonly 40, 58 or 105 watt tubes. The tubes are installed on the back of a metal box in continuous parallel lines with a distance of 20 to 30 centimeters between the lines, as well as between their outer boundaries and the box edges (see FIG. 1A). Sometimes the fluorescent light tubes are set to partly overlap, e.g., about 15 to 20 percent of their length (FIG. 1B).

The objective of a lighting system is to provide effective revealing power of desired information or display by achieving a high Light Output Ratio (LOR), while maintaining even illumination throughout the system. Overlighting is as undesirable as underlighting.

The prior art configurations of lighting systems are designed to utilize the direct light fluxes to illuminate all areas of the sign. Such lighting systems have, however, a number of drawbacks, some of which are always present, others may frequently prevail, as follows:

1) A high ratio of power to illuminated area (120–200 W/sqm);
2) A large number of lamps (3–4 lines) and low MTBF (1000–2000 hrs) for a 1 sqm sign;
3) Large lamp fixtures which block a substantial amount of the sign's back surface reflective potential;
4) An uneven distribution of illumination;
5) An uncomfortable level of glare in white sections of the sign;
6) The bodies of the fluorescent tubes are perceived as bright aspect lines;
7) Malfunctioning tubes cause the formation of dark areas;
8) Due to effects 4–6 above, the acrylic front covers of signs must have a high level of opacity and/or a multilayered sheet and their boxes require a depth of at least 22–30 cm.

It is therefore a broad object of the present invention to ameliorate the drawbacks of the prior art illuminated signs and to provide lighting systems having maximum available light flux.

It is a further object of the invention to provide lighting systems furnishing satisfactory illumination with minimal ratio of power to illumination area.

It is still a further object of the present invention to provide lighting systems furnishing satisfactory illumination by means of integration of light through controlled reflection and diffusion of light.

The above and other objects are achieved by providing a lighting system of the kind having walls defining an enclosure, at least one display face and one or more electrical light sources located within said enclosure, characterized in that adjacent individual light sources there are affixed light diffusers, interposed between said light sources and said display face so as to prevent light rays emanating from said sources from directly reaching said display face, but allow light rays reflected from internal surfaces of the walls of the enclosure, and from said diffusers, to reach said display face.

Projection of luminous flux from light sources into the space of a highly reflective enclosure is conducive to a very high Utilization Factor and a correspondingly high Total Illuminance on the front face of the enclosure. In fact, a "light box" is created, through which light energy is conserved and released only where it is desired.

While conventionally illuminated signs mainly exploit direct vertical illuminance, the "light box" method exploits a very high ratio of reflective illuminance to the point where total illuminance utilized approaches the value of the total light flux divided by the area of the transluscent (front) face.

Reflected light intensity is a function of surface reflectivity to the degree where the number of times a light beam is reflected varies from 1 to ∞. Total reflected light is therefore exponentially affected by improvements in the surface reflectivity.

The following is a quantitative illustration of the results of the maximization of reflective effect for a square sign having dimensions of 1 m×1 m×0.25 m:

Ev,Lv are the vertical illuminance and luminance on the front face at 100% reflectivity;

Es is the scalar illuminance (on all surfaces);

is the total light flux; and

Ls is the front transluscence taken at 0.60.

$$Es = \frac{F}{2\times 1 + 4\times 0.25} = \frac{F}{3}$$

$$Ev = \frac{F}{1\times 1} = F$$

$$Ev = 3\ Es$$

$$Ls = \frac{F}{3}\times 0.6 = \frac{F}{5}$$

$$Lv = F\times 0.6 + F\times 0.4 = F$$

$$\text{therefore, } Lv = 5\ Ls$$

The 1:5 ratio represents the rate of reduction of lighting power (Watts, for a given type of a light source) possible with the system presented, under the defined conditions. Hence, in accordance with the present invention, there may be achieved power reduction and savings of up to 75 or 80% of the power required with conventional lighting systems.

The rate of possible power reduction can practically be made to reach values as high as 10, depending on levels of reflectivity and on the proportion of effective transluscent-to-reflective area of the front of the sign. This effect is exploited in one-sided, as well as two-sided signs, to obtain maximum luminance where it is most desired. The increase in level and area of light reflection and the reduction in transluscent area of the front face, both have an exponentially magnifying effect on the level of externally perceived illumination. Illuminated display revealing power is increased even further through the light contrast created against a darkened background.

There are two tactical considerations underlying the configurations of the subject lighting system:

1) Optimization of LOR, and
2) Uniformity and redundancy (mutual compensation) of illumination.

The inverse square law of lighting indicates that cutting distances between light sources and targets, e.g., surfaces to be illuminated and visibly displayed, increases illuminance by an inverse square ratio.

The "cosine$^3$ law" of lighting predicates illuminance drops by a third power factor, for points situated both at distances and deflections from the normal line relative to the light source. This holds true also for the solid angle of light radiation between the light source and the surface illuminated. These lighting laws are put to use in this system in three ways:

1) Maximizing the LOR by shortening ranges of illumination in a distributed light source configuration;
2) Creating smoothly overlapping fields of illumination. Smoothness is achieved by blending fields of opposite gradients of intensity so that mutual reinforcement does not create visible contrast, and
3) Providing supportive redundancy through the overlapping fields of illumination for elimination of black shadow areas when a lamp burns out.

Light diffusers primarily diffuse and filter the intense illumination on the straight line from the light source to the display face or faces and are intended to enhance uniformity of illumination of the display face or faces of a sign. Their positioning, shape and dimensions are intended to balance the effect of the basic $\cos\theta^3$ law of lighting. This law basically states that illumination intensity is inversely proportional to the square of the distance of the target ($x^2 \cos\theta$) and also inversely proportional to the angle of incidence on the target. The combined distance and angle effects are hence porportional to $\cos\theta^3$—a fast decreasing exponential variable.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 7A:
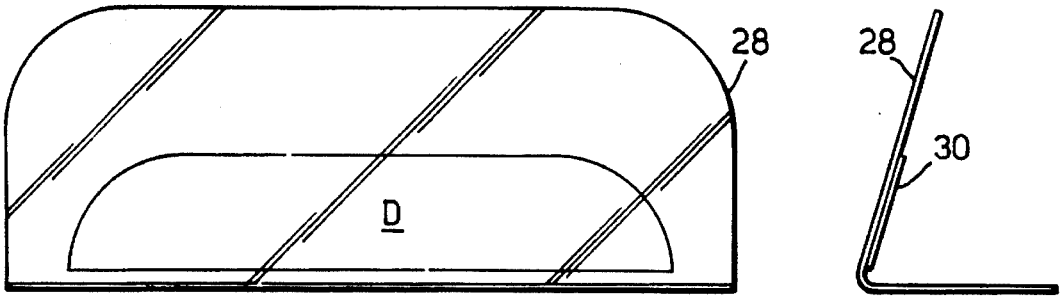
Figure 7B:
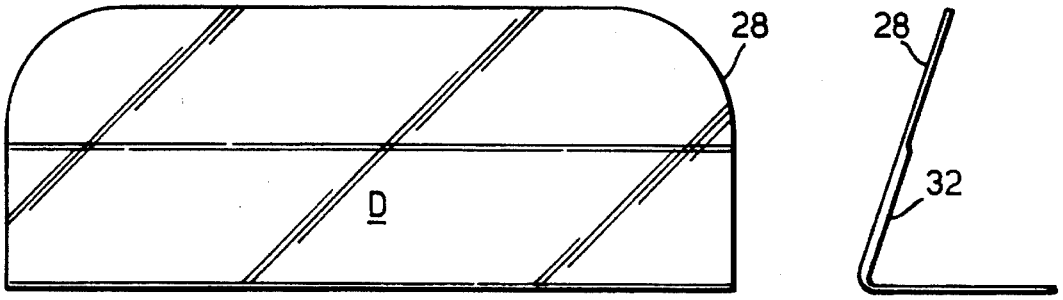
Figure 7C:
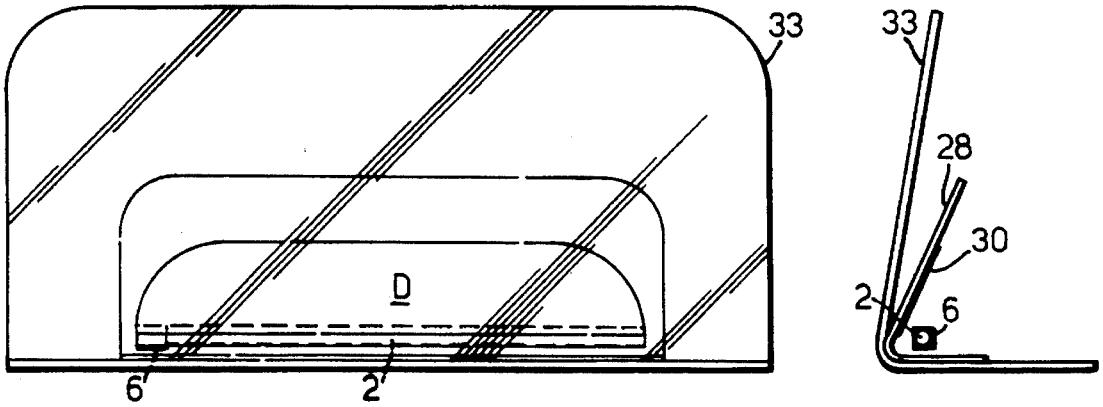
Figure 9A:
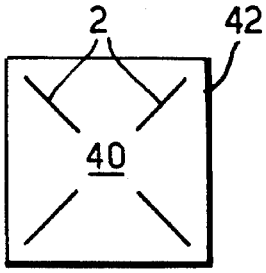
Figure 9B:
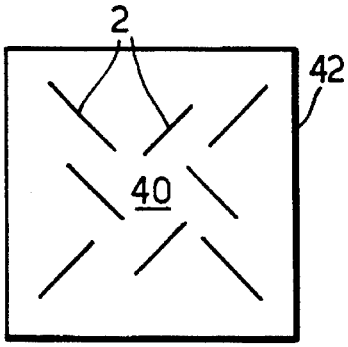
Figure 9C:
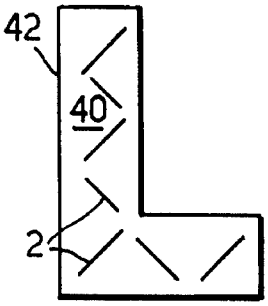
Figure 10A:
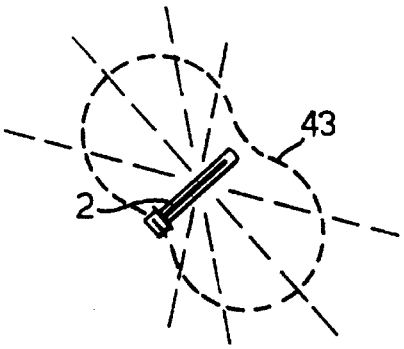
Figure 10B:
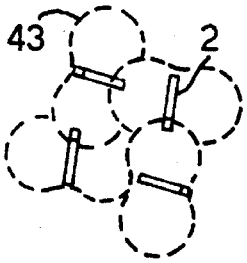
Figure 11A:
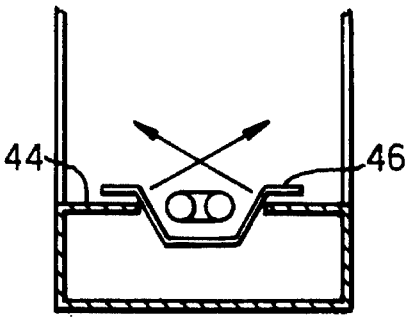
Figure 11B:
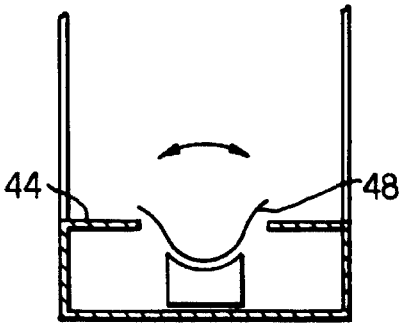

FIGS. 7A, 7B and 7C each include front and side views two embodiments of diffuser structures, in accordance with the present invention;

FIGS. 8A, 8B, 8C, 8D and 8E are cross-sectional views of different embodiments of diffusers in accordance with the present invention;

FIGS. 9A, 9B and 9C are schematic illustrations of different orientations of light sources affixed within illuminated structures, in accordance with the present invention;

FIGS. 10A and 10B are schematic illustrations of light distribution in lighting structures, in accordance with the present invention, and FIGS. 11A and 11B are cross-sectional views of further embodiments of lighting structures of the present invention.

Figure 1A:
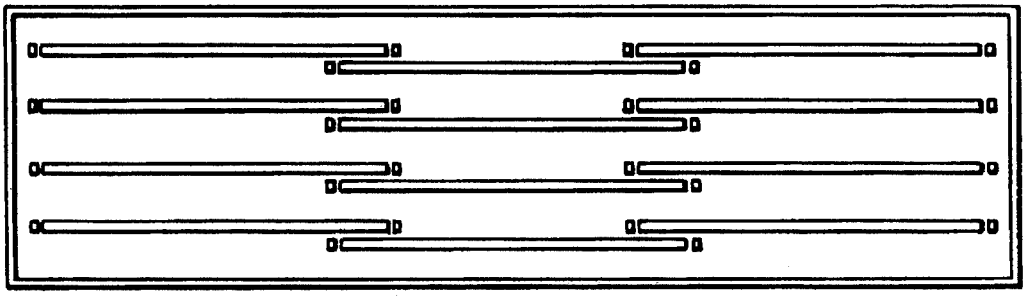
Fig.1A. (PRIOR ART)
FIGS. 1A and 1B are schematic representatives of prior art layout of lighting tubes in signs.
Figure 2B:
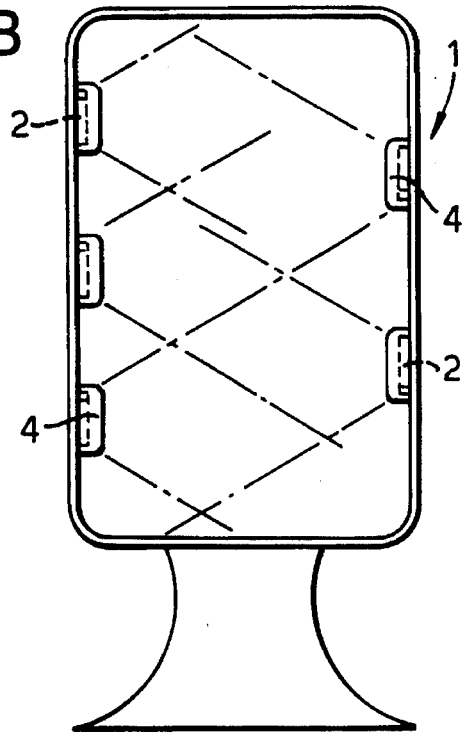
FIGS. 2A and 2B are schematic representations of illuminated signs utilizing diffusers and arranged in accordance with one embodiment of the present invention.
Figure 1B:
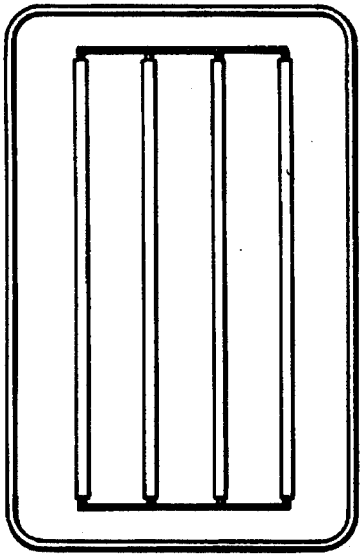
Fig.1B. (PRIOR ART)
Figure 2A:
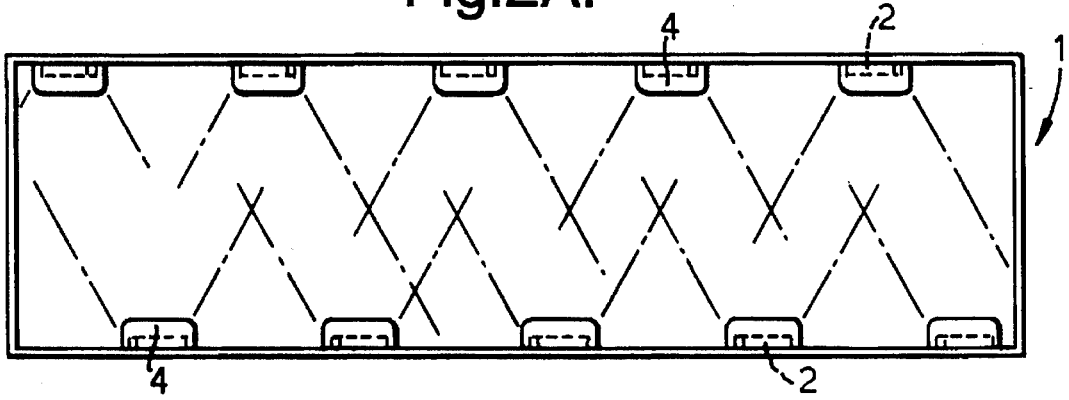

Referring to FIGS. 2A and 2B, there are illustrated shapes of commonly used signs 1, fitted with a multiplicity of light sources 2 affixed in a staggered fashion, along the walls thereof. Each of the lamps or light sources 2 is covered with a diffuser 4. As seen, the light sources are affixed inside the sign's enclosure for tangent lighting, namely, providing integrated internal illumination of the front display face, by placing the diffuser covered light sources on, or adjacent to, the sign's frame, with the lamp's axis (and reflector, where applicable), tangent to the front and possibly, rear, display face or faces.

Figure 3:
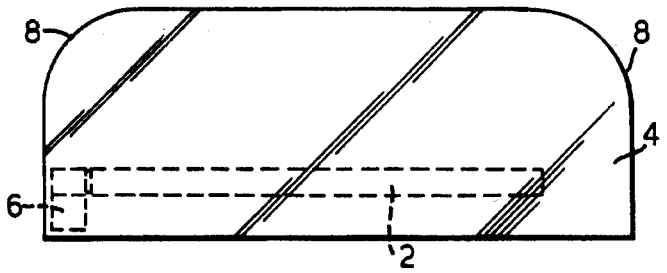
FIG. 3 is a front view of a diffuser positioned adjacent a lighting source.

In FIG. 3 there is seen an elongated light source 2, mechanically and electrically affixed, at one end thereof, to fixture 6 and a diffuser 4 disposed adjacent thereto. In this embodiment, the diffuser 4 is configured with rounded edges 8. The lamp fixture 6, as well as the diffuser is attached, for example, to a sign's wall or frame (not shown).

The diffuser 4 is most cost-effective when positioned close to the source of light 2 as its dimension can then be minimized. Care must also be taken, when designing a sign to avoid shadowing of the outer edge of the diffusers on the display surface. The above-mentioned laws of illumination and experimental data indicate that effective diffusion without edge shadowing is achieved when the diffusing surface is closer to the light source than to the display face or faces.

Figure 4:
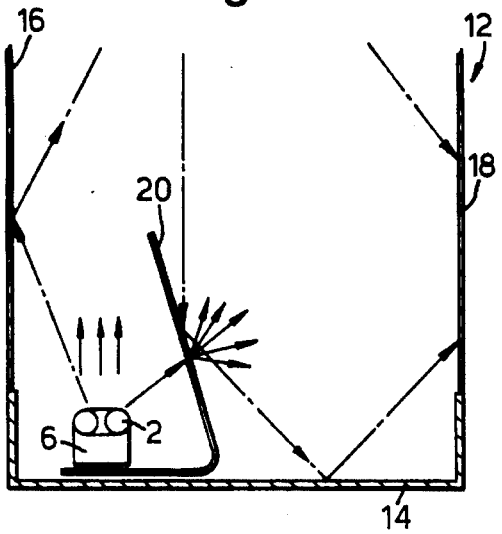
FIG. 4 is a schematic cross-sectional view of an illuminating structure showing a side view of a diffuser, according to the present invention.
Figure 5:
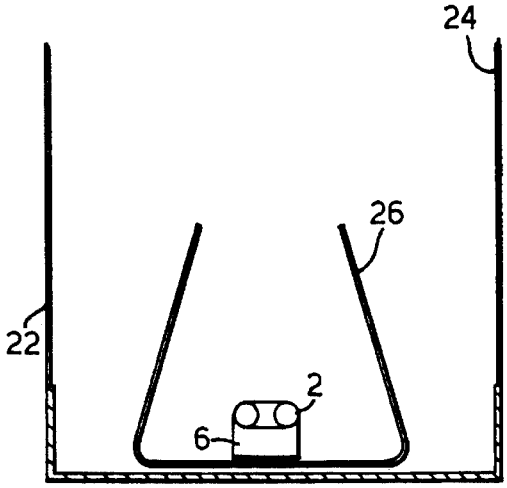
FIG. 5 is a schematic cross-sectional view of an illuminating structure according to a second embodiment of the invention.

In FIG. 4 there is schematically shown a lighting system according to the present invention, including a box or box-like structure 12. Seen are the bottom and rear walls 14, 16 and a front, display face 18. All of the internal surfaces of the structures' walls except for the display face or faces, are furnished with (highly) reflective material, as can be gathered by the arrowed hatched lines indicative of the light rays emanating from the light source 2 and reflected off the internal surfaces. In this embodiment of an illuminating structure having a single display face 18, a diffuser 20 having, in cross section, an L-shape is disposed between each of the light sources 2 and the display face 18. In case that the lighting system includes two oppositely disposed display surfaces 22 and 24 (FIG. 5), the diffuser 26 will assume in cross-section, a generally U-shape so as to be interposed between each of the display faces 22 and 24 and of the light source or sources 2.

Figure 6:
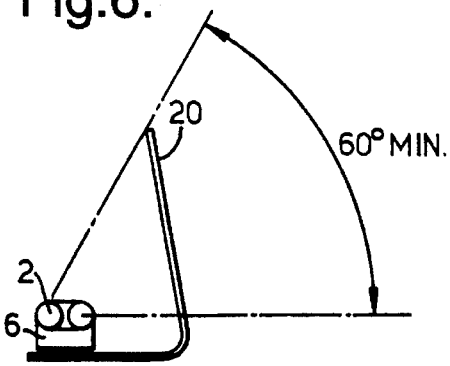
FIG. 6 is an explanatory representation showing a light source and a diffuser, in accordance with the present invention.

The diffusing effect on the display area is widest while most of the lamp scalar field of light is free to reach most internal reflection surfaces. It has been found that the optimum positioning of the diffusers 20 with respect to each light source is when their periphery is at a light incidence angle where the value of $\cos^3 O$ is small, e.g., around 60 degrees [$\cos^3 O = (½)^3 = ⅛$] (FIG. 6) as this prevents luminance gradients on the display surface.

Referring to FIGS. 7A, 7B and 7C, it can be seen that since the center zone D of the diffuser 28 is where $\cos\theta$ is closest to the value 1, light intensity is highest and often needs to be balanced by providing a zone D of a higher degree of opacity or filtering capability. This is achieved by adding a laminated light filtering film 30, or making the wall of the diffuser with a thicker material 32, so as to form a gradient on the diffuser. Alternatively, use may be made of a metalized film that will split the light and reflect part of it into the structure's internal cavity. In case a display face has several translucent zones, each requiring homogeneous, but different intensities of illumination, a thin-sheet, two-step diffuser 33 (FIG. 7C) is used. The diffuser sheets 28 and 33 have a lower opacity than that of a gradient diffuser. This limits light intensity loss while gaining a higher rate of light beam splitting, in two steps.

Setting the height and angle of inclination of the secondary diffuser 33 determines the area of diffused light on the front display face. The latter can be made to encompass the entire display surface or selected parts thereof only. As the diffuser reflects back a portion of the light, display areas outside its projected surface will receive a high portion of this additional illumination.

The angle of the side diffuser's surface with respect to the light source is determined by the following considerations:

1) If light is kept away from the display face about 15–30 cm, the diffuser 34 (FIG. 8A) will have an obtuse angle (open shape) in order to allow maximum light to be radiated into the structure's cavity.

2) When the light source 2 is close to the display face, such as in the case of a thin profile sign about 5–15 cm, the angle of the diffuser 35 will range from a right angle to a sharp angle (skewed shape) (FIG. 8B) and present a reflecting plane to secondary light rays reflected from other surfaces. The primary diffused light and secondary reflected light eliminate diffuser shadowing on the display face.

3) If the structure's cavity depth is significant—about 20 to 30 cm or more, the provision of a diffuser 36 (FIG. 8C) having an open shape with an additional skewed side wall will afford both, maximum light and a concealed or "fading" diffuser profile, as described in paragraphs 1 and 2 above.

Figure 8A:
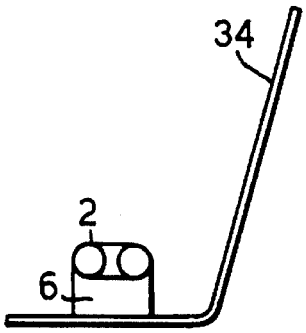
Figure 8B:
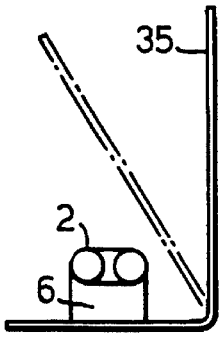
Figure 8C:
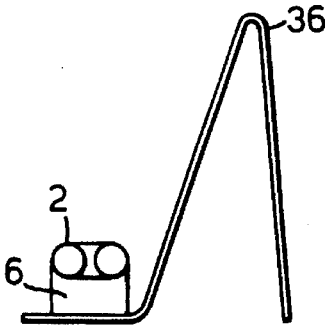
Figure 8D:
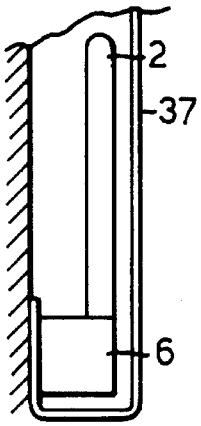
Figure 8E:
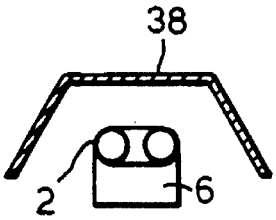

Additional, self-explanatory embodiments of diffusers 37 and 38 are, respectively illustrated in FIGS. 8D and 8E. For a front display lighting system, as e.g., shown in FIGS. 2A and 2B, a diffuser 37 is used, while for a three-sided display lighting system a diffuser 38 is more appropriate.

In addition to the usage of light diffusers as described above, for the purpose of providing an improved lighting system, when the light sources are affixed on the back wall of the structure, it is also proposed to improve the eveness of light rays distribution throughout the enclosure and thus, the lighting effect across the entire display face or faces. This is achieved by mounting light sources on the back wall of a lighting structure, in a special manner selected with respect to the structure's walls and configuration. Accordingly, in FIG. 9A there is illustrated a first manner of orienting a plurality of elongated light sources 2 on the structure's back wall 40 in a staggered fashion and diagonally with respect to the side walls 42 thereof. FIG. 9B illustrating dispositioning of elongated light sources 2 in a staggered fashion and diagonally with respect to the structure's side walls 42, however, with alternating directions of the axis of the light sources. This type of arrangement is suitable for large structures having large display faces. For relatively narrow structures having display faces of narrow cross-sections (FIG. 9C), the elongated light sources 2 are affixed to the back wall 40 in a diagonal fashion with respect to the walls 42 and in alternating axial orientation to each other. By alternating the direction of the strongest light vector of a light source (see FIG. 10A) there is obtained good meshing and mutual compensation of the light source foot-candle distribution pattern 43 (FIG. 10B). This pattern improves light uniformity and sustains it over areas of failed light sources.

Concealment of the actual light sources 2 can further be improved by mounting the illuminating part of a light source substantially flush with the surface 44 of a reflecting wall of a lighting structure while sinking into, below said surface 44, the mounting fixture of the light source, as illustrated in FIG. 11A. Individual light reflectors 46 (FIG. 11A) and 48 (FIG. 11B) may also be used. Such reflectors may be configured so as to direct unequal amounts of light rays in various directions, thereby directing different light intensities, towards various display zones or display faces of the lighting structure.

It will be evident to those skilled in the art that the invention is not limited to the details of the foregoing. illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A lighting system having a base and walls defining an enclosure, at least one display face bearing an at least partly translucent display, said display having a front viewing surface and a back surface and at least one electrical light source mounted on said base within said enclosure, characterized in that adjacent each individual light source there is affixed a light diffuser, interposed between said light source and said display face so as to illuminate said display from the back surface thereof and to prevent all light rays emanating from said source from directly reaching the back surface of said display face, but allow light rays reflected from internal surfaces of the walls of the enclosure and from said diffuser, to reach the back surface of said display face.

2. The system as claimed in claim 1, wherein said walls are provided with light reflecting material.

3. The system as claimed in claim 1, wherein said light sources are of the kind having a base comprising electrical terminals and an elongated light emitting tube.

4. The system as claimed in claim 1, wherein each of said diffusers is configured to exhibit, in cross-section, a substantial L-shape having two surfaces disposed at an angular relationship to each other and wherein one of said surfaces is affixed onto said base adjacent to a light source.

5. The system as claimed in claim 1, wherein each of said diffusers is configured to exhibit, in cross-section, a substantial U-shape having a web and two interconnected surfaces disposed at an angular relationship with respect to said web and wherein said diffuser is affixed onto said base adjacent to a light source, so as to substantially surround said source from three sides thereof.

6. The system as claimed in claim 4, wherein the angle included between two directly interconnected surfaces of said diffuser is an acute angle.

7. The system as claimed in claim 6, wherein said angle is in the range of between 60° to 80°.

8. The system as claimed in claim 4, wherein the angle included between two surfaces of said diffuser is an obtuse angle.

9. The system as claimed in claim 8, wherein said diffuser is provided with an additional surface interconnected with the free end of one of said surfaces, forming in cross-section with said surface, an inverted V-shape.

10. The system as claimed in claim 1, wherein said diffusers are provided along portions thereof with light filtering surfaces.

11. The system as claimed in claim 1, wherein said diffusers are made along at least one portion thereof with a surface of increased thickness.

12. The system as claimed in claim 1, wherein said diffusers are provided with at least two, spaced-apart sheets forming, on selected zones of the display face, illuminations of different intensities.

13. The system as claimed in claim 3, wherein said walls are constituted by front and side walls and wherein said light sources are affixed on the base of said enclosure in a staggered fashion, said elongated light emitting tube having an axis the axis of said elongated light sources extending diagonally to the side walls of the enclosure.

14. The system as claimed in claim 13, wherein the axis of some of said light sources traverse the axis of the other light sources.

15. The system as claimed in claim 1, wherein at least a portion of each of said light sources is disposed within the plane of a wall of said enclosure.

16. The system as claimed in claim 1, further comprising a light reflector positioned underneath at least some of said light sources.

* * * * *